US007836969B2

(12) United States Patent
Ahola et al.

(10) Patent No.: US 7,836,969 B2
(45) Date of Patent: Nov. 23, 2010

(54) METHOD FOR CONTROLLING PRESSURE FLUID OPERATED PERCUSSION DEVICE, AND PERCUSSION DEVICE

(75) Inventors: Erkki Ahola, Kangasala (FI); Mauri Esko, Ikaalinen (FI); Aimo Helin, Tampere (FI); Markku Keskiniva, Ylöjärvi (FI); Jorma Mäki, Mutala (FI); Juha Piispanen, Tampere (FI)

(73) Assignee: Sandvik Mining and Construction OY, Tampere (FI)

( * ) Notice: Subject to any disclaimer, the term of this patent is extended or adjusted under 35 U.S.C. 154(b) by 247 days.

(21) Appl. No.: 11/794,615

(22) PCT Filed: Jan. 4, 2006

(86) PCT No.: PCT/FI2006/050006

§ 371 (c)(1),
(2), (4) Date: May 14, 2008

(87) PCT Pub. No.: WO2006/072666

PCT Pub. Date: Jul. 13, 2006

(65) Prior Publication Data

US 2009/0266568 A1 Oct. 29, 2009

(30) Foreign Application Priority Data

Jan. 5, 2005 (FI) ..... 20050012

(51) Int. Cl.
*E21B 7/001* (2006.01)

(52) U.S. Cl. ..... 173/1; 173/13; 173/91

(58) Field of Classification Search ..... 173/1, 173/2, 4, 11, 13, 91, 200, 201, 206, 212; 175/25, 26

See application file for complete search history.

(56) References Cited

U.S. PATENT DOCUMENTS

| | | | | | |
|---|---|---|---|---|---|
| 3,670,826 | A | * | 6/1972 | Hanson et al. | 173/4 |
| 4,023,626 | A | * | 5/1977 | Salmi et al. | 173/8 |
| 4,699,223 | A | * | 10/1987 | Noren | 175/40 |
| 5,117,921 | A | * | 6/1992 | Bartels et al. | 173/13 |
| 5,129,466 | A | * | 7/1992 | Bartels et al. | 173/13 |
| 5,844,133 | A | * | 12/1998 | Goto et al. | 73/152.54 |

(Continued)

FOREIGN PATENT DOCUMENTS

FI 2003-0261 9/2004

(Continued)

*Primary Examiner*—Thanh K. Truong
*Assistant Examiner*—Nathaniel Chukwurah
(74) *Attorney, Agent, or Firm*—Drinker Biddle & Reath LLP

(57) ABSTRACT

The invention relates to a method for controlling a pressure fluid operated percussion device comprising a working chamber for pressure fluid and in the working chamber a transmission piston installed movably with respect thereto so as to enable a tool installed in the percussion device to be pressed against a material to be broken in order to generate a stress pulse, and to a percussion device.

The method comprises adjusting the length of the stress pulse by adjusting the time during which pressure influences the transmission piston. The percussion device comprises an adjustment element and adjustment means for adjusting the influence time of the pressure of the pressure fluid being fed via a control valve and influencing the transmission piston.

21 Claims, 4 Drawing Sheets

U.S. PATENT DOCUMENTS

| | | | | |
|---|---|---|---|---|
| 6,505,689 | B1 * | 1/2003 | Poysti et al. | 173/4 |
| 6,742,605 | B2 * | 6/2004 | Martini | 175/57 |
| 6,799,641 | B1 * | 10/2004 | Lyon et al. | 173/17 |
| 7,013,996 | B2 * | 3/2006 | Keskiniva et al. | 175/135 |
| 2006/0032649 | A1 * | 2/2006 | Keskiniva et al. | 173/213 |
| 2006/0175091 | A1 * | 8/2006 | Koskimaki et al. | 175/51 |

FOREIGN PATENT DOCUMENTS

| | | | | |
|---|---|---|---|---|
| FI | 2003-1036 | | 2/2005 | |
| GB | 2190147 | | 11/1987 | |
| SU | 814716 | | 3/1981 | |
| WO | WO2004/073933 | * | 9/2004 | 173/91 |

* cited by examiner

METHOD FOR CONTROLLING PRESSURE FLUID OPERATED PERCUSSION DEVICE, AND PERCUSSION DEVICE

BACKGROUND OF THE INVENTION

The invention relates to a method for controlling a pressure fluid operated percussion device which allows a tool movable in its longitudinal direction with respect to a body of the percussion device to be installed therein, and which comprises a working chamber and therein a transmission piston installed movably in the axial direction of the tool in order to suddenly compress the tool in its longitudinal direction by a pressure of pressure fluid influencing the transmission piston such that a stress pulse is generated in the tool in its longitudinal direction and the stress pulse progresses through the tool into a material to be broken, a control valve which includes inlet and discharge channels for conveying pressure fluid to and from the percussion device and which also includes a movably installed switch element provided with channels for switching, via the channels of the switch element, the inlet channels and, similarly, the discharge channels to alternately feed pressure fluid into the working chamber to influence the transmission piston and, similarly, to discharge pressure fluid that influenced the transmission piston from the working chamber.

The invention further relates to a percussion device which allows a tool to be installed therein movably in its longitudinal direction with respect to a body of the percussion device, and which comprises a working chamber and therein a transmission piston installed movably in the axial direction of the tool in order to suddenly compress the tool in its longitudinal direction by a pressure of pressure fluid influencing the transmission piston such that a stress pulse is generated in the tool in its longitudinal direction and the stress pulse progresses through the tool into a material to be broken, a control valve which includes inlet and discharge channels for conveying pressure fluid to and from the percussion device and which also includes a movably installed switch element provided with channels for switching, by means of the switch element and via the channels thereof, the channels to alternately convey pressure fluid into the working chamber to influence the transmission piston and, similarly, to discharge pressure fluid that influenced the transmission piston from the working chamber.

In the claimed percussion device, a stress pulse is generated such that a transmission piston residing in a separate working chamber is arranged to be influenced by the pressure of pressure fluid, most preferably relatively suddenly. The influence of the pressure pushes the transmission piston towards a tool. Consequently, the tool becomes compressed, whereby a stress pulse is generated in the tool and the stress pulse progresses therethrough, and when the tip of the tool is in contact with rock or another hard material to be broken, makes the material break down. In order to control its striking operation, the percussion device may utilize a rotatable or reciprocally linearly movable switch element which typically comprises successive openings to ultimately open a connection from a pressure fluid source to the transmission piston of the percussion device and, similarly, from the transmission piston to a pressure fluid reservoir. When drilling conditions change, or for some other reasons, it is sometimes desirable to change the frequency at which stress pulses are generated, which is easy to carry out by adjusting the speed of movement of the switch element. However, a problem arises in that when the speed of movement of the switch element increases, the times during which pressure fluid channels are open become shorter. This contributes to changing the operation and behaviour of the device, which is not desirable.

BRIEF DESCRIPTION OF THE INVENTION

An object of the present invention is to provide a method and a percussion device so as to enable the generation times of a stress pulse to be adjusted as desired and, for example, the shortenings of the times during which pressure fluid channels are open due to an increase in the speed of movement to be compensated for.

The method of the invention is characterized in that in order to adjust the length of the stress pulse, the time during which the pressure of the pressure fluid influencing the transmission piston and, therethrough, pressing the tool, influences the tool is adjusted. The percussion device of the invention is characterized in that it comprises an adjustment element provided with channels for pressure fluid, that the switch element is arranged to convey pressure fluid to and from the working channel via the channels of the adjustment element, and that it comprises adjustment means for adjusting, by means of the adjustment element, the influence time of the pressure of the pressure fluid being fed to the percussion device via the control valve and influencing the transmission piston and, therethrough, compressing the tool.

An idea underlying the invention is that the influence time of the pressure of the pressure fluid is adjusted by adjusting either the time during which the pressure fluid inlet channel/s is/are open and/or the speed of movement of the switch element of the control valve. The idea underlying an embodiment of the invention is that different sides of the switch element of the control valve, in the pressure fluid inlet and discharge channels, are provided with at least partly aligned openings, and at least one side of the switch element is provided with an adjustment element movable in the direction of movement of the switch element such that by moving the adjustment element, the mutual position of the openings may be adjusted so that the length of parts of the aligned openings in the direction of movement changes. In accordance with a second embodiment of the invention, the adjustment is carried out with respect to the speed of movement of the switch element such that the length of the parts of the aligned openings in the direction of movement of the switch element is proportional to the speed of movement. This adjusts the time during which the pressure fluid channels are open proportionally to the speed of movement such that the time during which the channels are open, and thus the generation time of a stress pulse, is substantially always the same, irrespective of the speed of movement. In accordance with a third embodiment of the invention, the adjustment element is installed outside the switch element of the control valve. In accordance with a fourth embodiment of the invention, the adjustment element is installed as an integral part of the switch element.

An advantage of the invention is that the length of the stress pulses can be adjusted according to given drilling conditions. A further advantage is that when adjusting the frequency of the stress pulses, it is possible at the same time to adjust the length of stress pulses and thus, irrespective of a change in the frequency, to generate stress pulses of a desired length.

BRIEF DESCRIPTION OF THE DRAWINGS

The invention will be described in closer detail in the accompanying drawings, in which FIGS. 1*a* and 1*b* schematically show embodiments of a percussion device of the invention, FIGS. 2*a* and 2*b* schematically show an embodiment of the invention, FIGS. 3*a* and 3*b* schematically show another embodiment of the invention, and FIG. 4 schematically shows a preferred embodiment of the invention.

DETAILED DESCRIPTION OF THE INVENTION

Figure 1A:
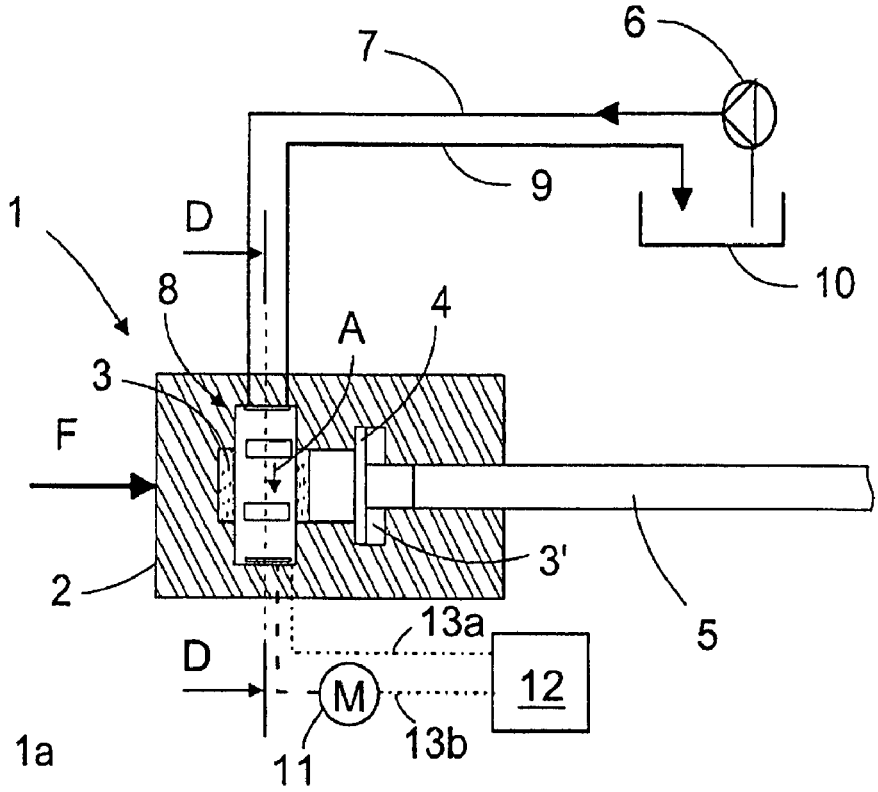

FIG. 1*a* is a schematic sectional view showing a percussion device 1 according to the invention, comprising a body 2 provided with a working chamber 3 therewithin, and in the working chamber 3 a transmission piston 4. The transmission piston 4 is located co-axially with a tool 5, and it may move in the axial direction thereof such that the transmission piston 4, during generation of a stress pulse, comes into contact with the tool 5 or with a shank known per se attached thereto. A side of the transmission piston 4 opposite to the tool is provided with a pressure surface facing the working chamber 3. In order to generate a stress pulse, pressurized pressure fluid is fed from a pressure source, such as a pump 6, to the working chamber 3 along an inlet channel 7 via a control valve 8. The control valve comprises a movable switch element (shown in more detail in FIGS. 2*a* to 3*b*) provided with channels, such as openings or grooves, which alternately connect a first inlet channel leading to the switch element and a second inlet channel leading from the switch element to the working chamber and, similarly, a second discharge channel provided from the working chamber to the switch element and a first discharge channel leading away from the switch element. A stress pulse is generated when the pressure of the pressure fluid pushes the transmission piston 4 towards the tool 5 and, therethrough, compresses the tool 5 against the material to be broken. After having traveled through the tool 5, the stress pulse, upon being transferred via the tip of the tool, such as a drill bit, in a manner known per se to the material to be broken, such as rock, thus causes the material to break down. When the switch element of the control valve 8 stops the pressure fluid from entering the working chamber and subsequently discharges the pressure fluid that influenced the transmission piston 4 from the working chamber 3 along a discharge channel 9 to a pressure fluid reservoir 10, the stress pulse dies away and the transmission piston 4, which has moved a short distance, only some millimetres in the direction of the tool 5, is allowed to return to its original position before the switch element of the control valve 8 again lets pressure fluid to enter the working chamber 3, which causes a new stress pulse to be generated. During the use of the percussion device, it is pushed in a manner known per se at a feed force F towards the tool 5 and simultaneously towards the material to be broken. In order to return the trans-mission piston 4, pressure medium may be fed to a chamber 3' between stress pulses, if necessary, or the transmission piston may be returned by mechanical devices, such as a spring.

In the case shown in FIG. 1*a*, the control valve 8 comprises a rotatably co-axially with the tool 5 movable switch element which is rotated around its axis in the direction of arrow A by a suitable rotating mechanism, such as a motor 11, by means of power transmission schematically depicted in a broken line. Alternatively, the switch element is rotatably turned back and forth by a suitable mechanism. Such a rotatably movable switch element may also be located otherwise, e.g. in the body 2, installed onto a side of the working chamber 3. Instead of a rotatably movable switch element, the control valve 8 may also utilize a reciprocally movable switch element. Furthermore, in both cases it is possible to use a control valve whose switch element only comprises one channel for conveying pressure fluid to and from the working chamber. Preferably, however, the switch element of the control valve 8 comprises a plurality of parallel channels. FIG. 1*a* further shows a control unit 12, which may be connected to control the rotation speed of the control valve or the speed of movement of the reciprocally movable control valve and which comprises adjustment means for adjusting, in manners similar to those shown in FIGS. 2*a* to 3*b*, the influence time of the pressure of the pressure fluid by adjusting the time during which the openings of the pressure fluid channels are open e.g. in proportion to the speed of movement of the switch element. This is schematically shown in broken lines 13*a* and 13*b*. Such an adjustment can be implemented by many different techniques known per se by using desired parameters, such as drilling conditions, e.g. the hardness of a rock to be broken.

Figure 1B:
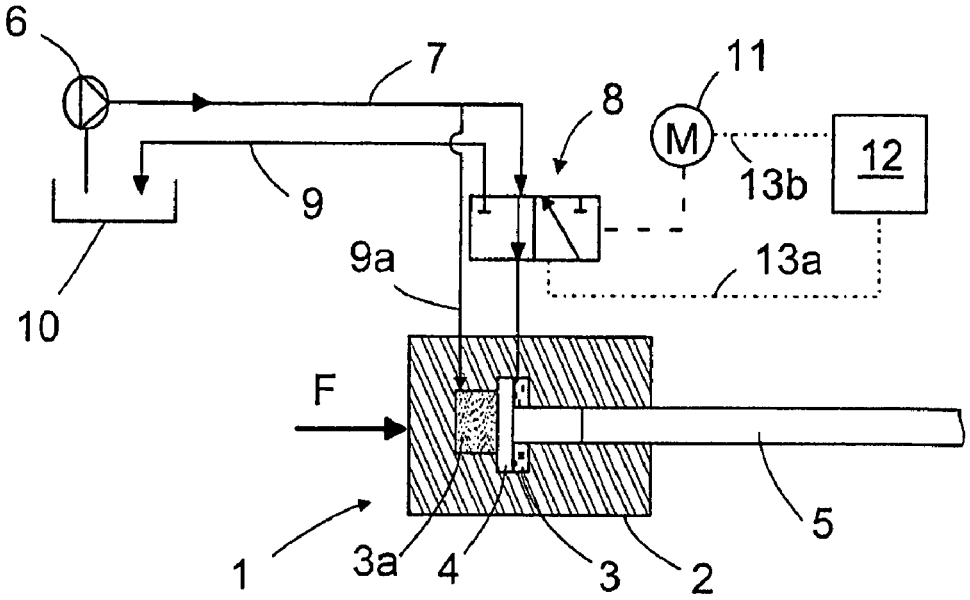

FIG. 1*b* is a schematic sectional view showing a second percussion device 1 according to the invention, comprising a body 2 provided with a working chamber 3 therewithin, and in the working chamber 3 a trans-mission piston 4. In this embodiment, the transmission piston 4 is influenced by a continuous pressure of pressure fluid via a channel 9*a*. With respect to the transmission piston 4, the channel 9*a* is connected with an auxiliary chamber 3*a* residing on a side opposite to a tool 5. Similarly, for the operation of the percussion device and with respect to the transmission piston 4, the working chamber 3 resides on a side of the tool 5. Hence, in order to generate a stress pulse, pressure fluid is discharged from the working chamber 3 for a period of time of a desired length, so that the pressure of the pressure fluid in the auxiliary chamber pushes the transmission piston towards the tool. At the same time, the tool becomes compressed, and a stress pulse is generated. Similarly, the transmission piston 4 is returned to its original position by feeding pressure fluid into the working chamber 3, in which case the transmission piston stops pressing the tool and the stress pulse dies away. In the case of FIG. 1*b*, the adjustment takes place in the same way as in FIG. 1*a* but in the figure it is the discharge of the pressure fluid from the working chamber 3 that is adjusted. The figure schematically depicts the valve 8 as a conventional reciprocally movable switch element, but the details in accordance with the invention will be shown below in FIGS. 2*a* and 2*b*. The motor 11 may be any device capable of producing a reciprocal movement which operates either mechanically, hydraulically, pneumatically or electrically.

Figure 2A:
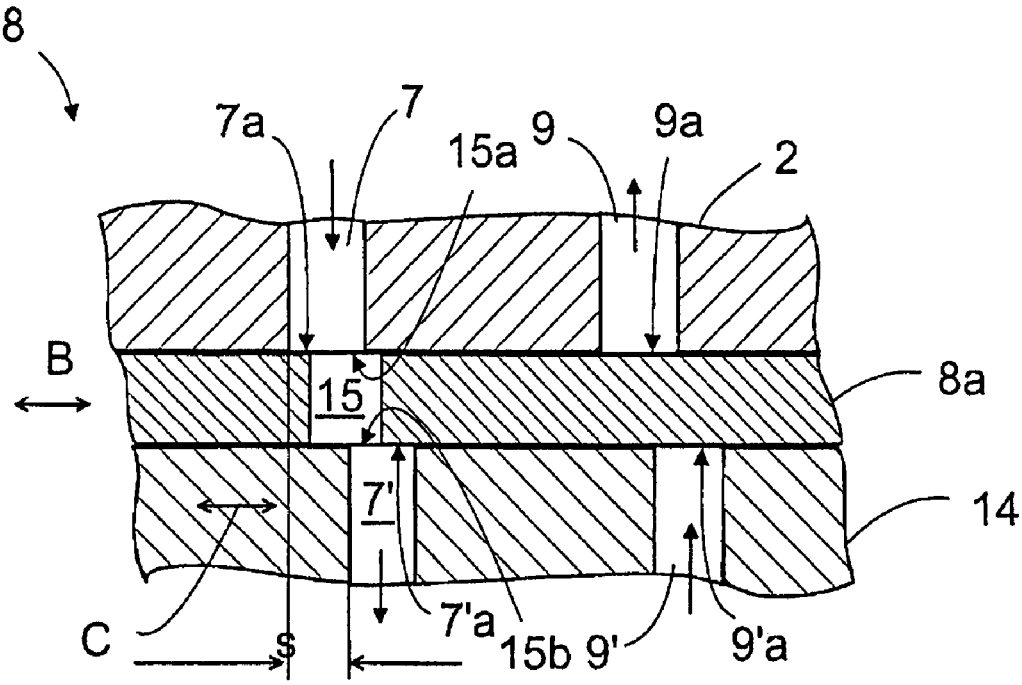
Figure 2B:
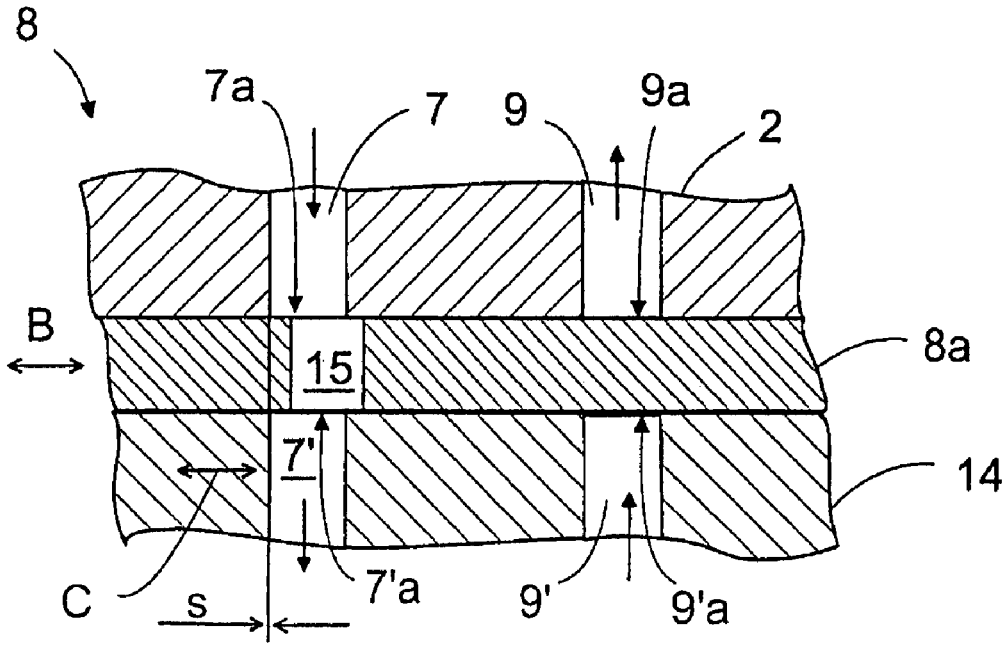

FIGS. 2*a* and 2*b* schematically show an embodiment of the invention. The figures only show a part of e.g. a control valve 8 equipped with a reciprocally movable switch element 8*a* and a body 2 of a percussion device. One side of the control valve 8 is provided with pressure fluid inlet channels 7 and discharge channels 9 which terminate at the switch element 8*a* and whose openings 7*a* and 9*a* facing the switch element 8*a* are included in the control valve 8. In this example, these channels are fixedly formed in the body 2 of the percussion device, so that their position with respect to the body 2 is always constant. On the other side of the switch element 8*a* with respect to the body 2 of the percussion device, the control valve 8 comprises an adjustment element 14 which is parallelly with the direction of movement B of the switch element 8*a* reciprocally movable, as shown by arrow C, and which similarly comprises channels 7' and 9' connected with the working chamber 3 of the percussion device 1. Similarly, their openings 7'*a* and 9'*a* included in the control valve are directed towards the switch element 8*a*. The switch element 8*a* of the control valve 8 is further provided with channels 15 therein having the form of a groove therein formed in a surface thereof or an opening provided therethrough, such that openings 15*a* and 15*b* of these channels alternately connect the channels 7 and 7' and, similarly, the channels 9 and 9' such that pressure fluid flows to and from the working chamber 3.

In the situation shown in FIG. 2*a*, the position of the adjustment element 14 is such that the openings 7'*a* and 9'*a* of the channels 7' and 9' of the adjustment element 14 are arranged to overlap with respect to the openings 7*a* and 9*a* of the inlet and discharge channels 7 and 9 provided in the body 2 in the direction of movement of the switch element 8*a* by a distance s. In such a case, when the switch element 8*a* moves, only a portion of the cross-sectional areas of the openings 7*a* and 7'*a* and, similarly, 9*a* and 9'*a* of the channels 7 and 7' and the channels 9 and 9', respectively, are simultaneously connected with one another via the openings 15*a* and 15*b* of the channels 15 of the switch element 8*a*. This is because when the openings 7*a* and 15*a* of the channels 7 and 15 open into one another, the opening 7'*a* of the channel 7' opens into connection with the opening 15*b* of the channel 15 only later, after the switch element 8*a* has moved by yet another distance s in the same direction. Similarly, the opening 7*a* of the channel 7 closes up away from connection with the channel 15 already at a distance s before the opening of the channel 7' closes up away from connection with the channel 15. The openings 9*a* and 9'*a* of the channels 9 and 9' connect in a similar manner. At a certain speed of movement of the switch element 8*a* of the control valve 8, it is thus possible to achieve an influence time t of a given length for a stress pulse of the pressure fluid influencing the transmission piston 4, which is necessary in order to generate stress pulses of given lengths.

In the situation according to FIG. 2*b*, the adjustment element 14 has been moved to a position wherein the openings of the channels 7' and 9' of the adjustment element 14 are arranged in complete alignment with respect to the inlet and discharge channels 7 and 9 provided in the body 2, i.e. the distance s=0. In such a case, when the switch element 8*a* of the control valve 8 moves, the openings 7*a* and 7'*a* of the channels 7 and 7' open into connection with the openings 15*a* and 15*b* of the channel 15 simultaneously and, similarly, close up away from connection with the channel 15 simultaneously. Consequently, the entire cross-sectional area of the openings 7*a* and 7'*a* as well as 9*a* and 9'*a* of the channels 7 and 7' and the channels 9 and 9', respectively, simultaneously becomes interconnected via the channels 15 of the switch element 8*a* and, similarly, it takes the pressure fluid longer to flow. In this situation, the time during which the pressure fluid influences the tool via the transmission piston 4 is at its longest.

By arranging the adjustment element 14 in different positions, it is possible to produce pressure fluid influence times of different lengths at a certain speed of movement of the switch element 8*a*. It is thus possible to adjust the time during which the pressure fluid influences the tool 5 via the transmission piston 4 by adjusting the position of the adjustment element 14 and, therethrough, the mutual position of the openings of the pressure fluid inlet and discharge channels with respect to one another.

When the movement of the switch element 8*a* of the control valve 8 is sped up, a result is an increase in the frequency of stress pulses. Consequently, however, the pressure fluid influence time in the position shown in FIG. 2*a* would also become shorter, i.e. the generation time of stress pulses would become shorter, which is sometimes harmful as far as the operation of the percussion device is concerned. Thus, when the speed of movement increases, the adjustment element 14 may be similarly moved such that the openings 7'*a* and 9'*a* of its channels 7' and 9' become more aligned with the openings 7*a* and 9*a* of the inlet and discharge channels 7 and 9 provided in the body 2. In theory, when the speed of movement of the switch element 8*a* of the control valve 8 becomes multiplied by two, the length of the aligned openings in the direction of movement of the switch element 8*a* also has to be multiplied by two so as to enable a generation time of stress pulses of the same length to be achieved by the higher speed of movement and the consequent higher frequency of stress pulses.

Figure 3A:
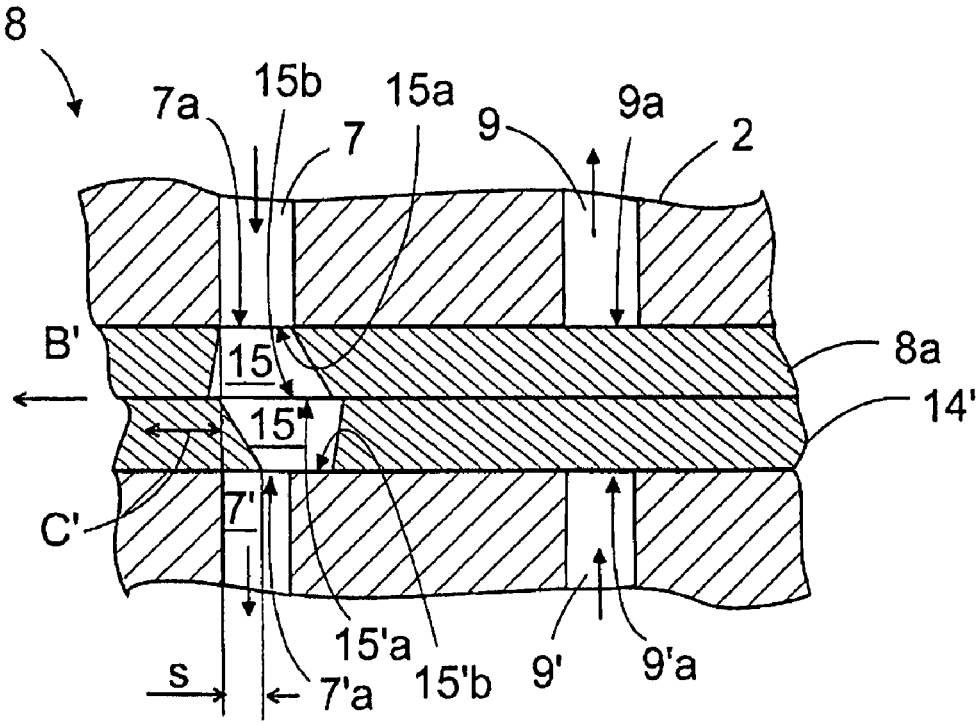
Figure 3B:
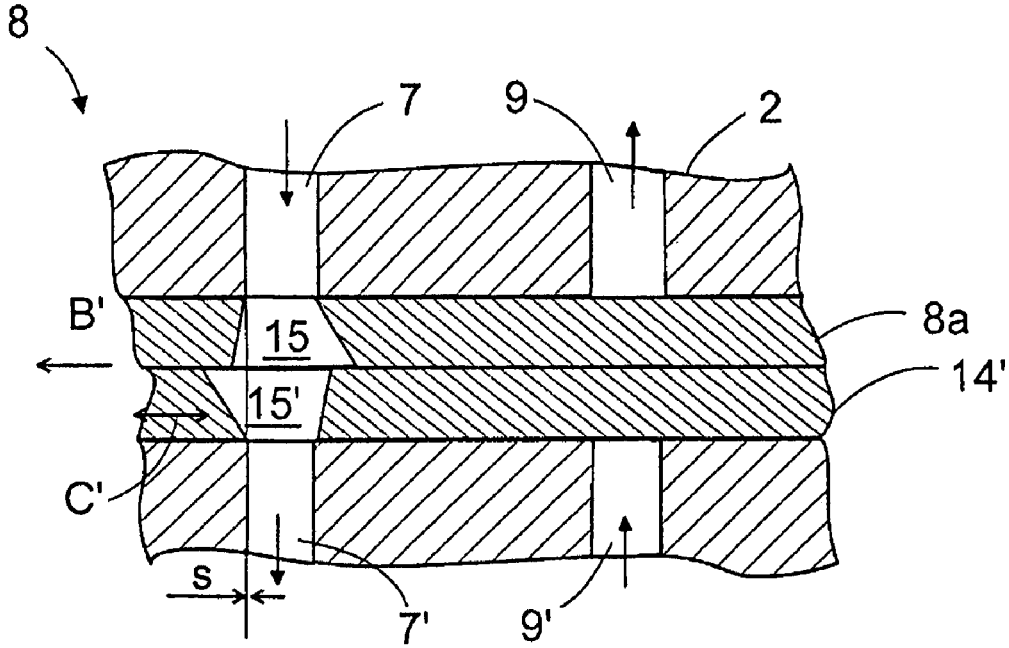

FIGS. 3*a* and 3*b* schematically show another embodiment of the invention. The figures further show only a part of a switch element 8*a* which moves, i.e. rotates, in the same direction, e.g. as indicated by arrow B', as well as of a body 2 of a percussion device. A control valve 8, on one side of the switch element 8*a*, is provided with pressure fluid inlet and discharge channels 7 and 9 whose openings 7*a* and 9*a* are situated towards the switch element 8*a*. The other side of the switch element 8*a* in the body 2 of the percussion device is provided with other pressure fluid channels 7' and 9', respectively, connected with a working chamber 3. Similarly, openings 7'*a* and 9'*a* of these channels are situated towards the switch element 8*a*. The inlet and discharge channels 7 and 9 and, similarly, the channels 7' and 9' reside immovably with respect to one another.

The switch element 8*a* of the control valve 8 is therein provided with channels 15 which have the shape of a groove formed in a surface of the switch element 8*a* or an opening provided therethrough. The switch element 8*a* further comprises an adjustment element 14' which moves along with the switch element and which is movable with respect the switch element as indicated by arrow C' such that the adjustment element is similarly provided with channels 15' which have the shape of a groove formed in a surface thereof or an opening provided therethrough and which are connected with the channels 15. The channels 15 and 15' alternately connect the channels 7 and 7' and, similarly, the channels 9 and 9' such that pressure fluid flows to and from the working chamber 3.

In the situation shown in FIG. 3*a*, the position of the adjustment element 14' with respect to the switch element 8*a* is such that the openings 15*a* and 15'*b* of the channels 15 and 15' situated towards the channels 7 and 7' and, similarly, the channels 9 and 9' partly overlap by a distance s in the disrection of movement of the switch element 8*a*. In such a case, it is possible at a given speed of movement of the switch element 8*a* to achieve an influence time t of a given length for a stress pulse of the pressure fluid influencing the transmission piston 4.

In the situation of FIG. 3*b*, the adjustment element 14', with respect to the switch element 8*a*, has been moved into a position wherein the openings 15*a* and 15'*b* of the channels 15 and 15' are arranged to reside in complete alignment with respect to one another in the direction of movement of the switch element 8*a*, the distance s being 0. In such a case, when the switch element 8*a* moves, the entire cross-sectional area of the openings 7*a* and 7'*a* of the channels 7 and 7' as well as the openings 9*a* and 9'*a* of the channels 9 and 9', respectively, simultaneously becomes interconnected via the openings 15*a* and 15'*b* of the channels 15 and 15'. In this situation, similarly to that shown in FIG. 2*b*, it takes the pressure fluid longer to flow, and the time during which the pressure fluid influences the tool via the transmission piston 4 is at its longest.

In order to prevent the movement of the adjustment element 14' with respect to the switch element 8*a* of the control valve 8 from causing throttling in the flow of pressure fluid, the openings 15*b* and 15'*a* of the channels 15 and 15' of the adjustment element 14' and the switch element 8*a*, facing one another, are elongated in the direction of movement of the switch element and the adjustment element 14' included therein such that across the entire adjustment range and even at their smallest, the portions of the openings thereof that are simultaneously in alignment are at least as large as the openings 15*a* and 15'*b* of the channels 15 and 15' on the side of the openings 7*a* and 7'*a* as well as 9*a* and 9'*a* of the channels 7 and 7' and the channels 9 and 9', respectively.

Figure 4:
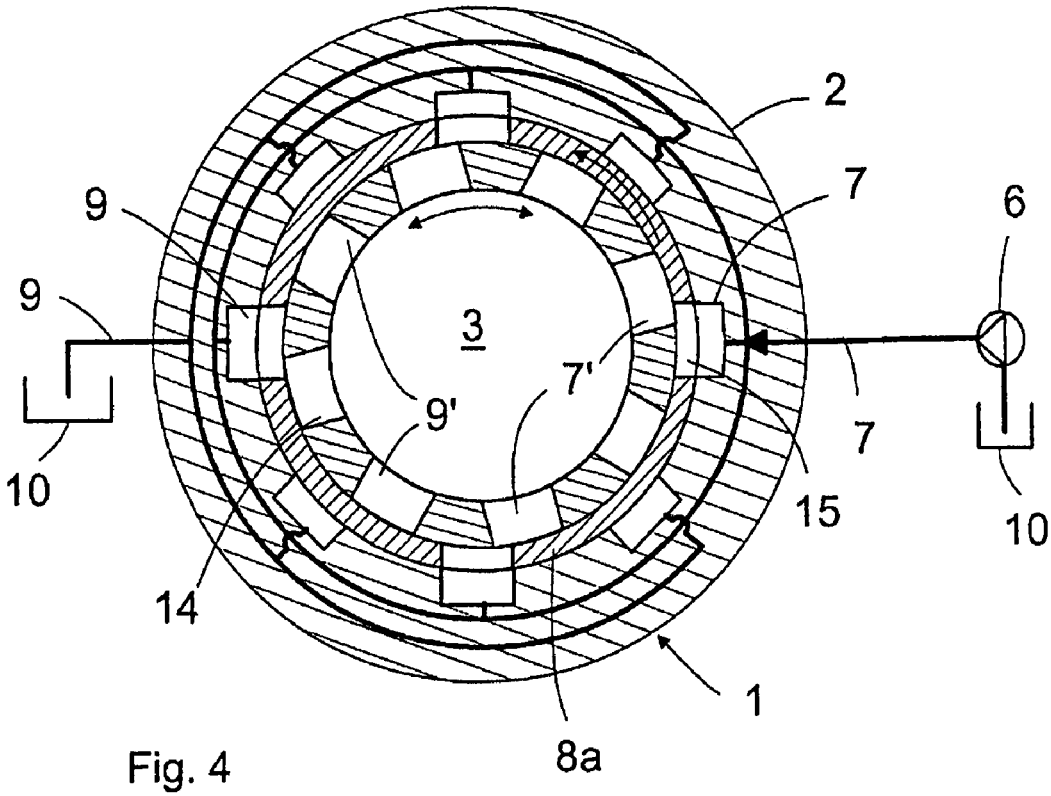

FIG. 4 is a schematic view showing an embodiment of a control valve implemented with a rotatable switch element and applying a method according to the invention in a section taken along line D-D in FIG. 1. For the sake of clarity, the figure shows no means for rotating and adjusting a switch element for adjusting an opening. FIG. 4 shows a cross-section of a body of a percussion device in a section at a rotatable switch element of the control valve 8. It shows how pressure fluid inlet channels are formed in the body 2 of the percussion device such that the periphery of the rotatable switch element 8*a* is provided with a plurality of parallelly operating pressure fluid inlet channels 7 and, similarly, a plurality of parallel pressure fluid discharge channels 9, whose openings are situated towards the switch element 8*a*. Obviously, these channels eventually come together to form a single inlet channel 7 from a pressure fluid pump 6 and, similarly, a single discharge channel 9 to a pressure fluid reservoir, pressure fluid tubes being connected thereto in a manner known per se for conveying pressure fluid to and from the percussion device. In this example, these pressure fluid inlet and discharge channels 7 and 9 are provided in the body 2 of the percussion device in manners known per se. The control valve 8, inside the switch element 8*a* with respect to the body 2 of the percussion device 1, is provided with an adjustment element 14, installed rotatably co-axially with the switch element 8*a*. The adjustment element 14 can be rotated by a mechanism known per se. Hence, the rotating mechanism may be pressure fluid operated, mechanically operated, etc. It may also be provided with adjustment devices connected thereto which are dependent on the rotation speed of the switch element 8*a* of the control valve 8 and which are implemented by various mechanisms. Similarly, the adjustment of the adjustment element 14 electrically is applicable in manners known per se.

Most preferably, the position of the adjustment element 14 is connected to be automatically dependent on the speed of the switch element 8*a* of the control valve 8. In such a case, a rotation speed range is determined for the switch element 8*a*, which includes the minimum and maximum values for rotation speed such that the rotation speed of the switch element 8*a* is to reside between these values. When the rotation speed is at its lowest, the adjustment element 14 is in the position shown in FIG. 2*a*, wherein the position with respect to one another of the inlet openings 7 and 7' and, similarly, the discharge openings 9, 9', which are situated on an opposite side of the switch element 8*a*, is such that the length of the openings in alignment in the direction of movement, i.e. rotation, of the switch element 8*a*, and thus the largest simultaneous cross-section in alignment, is as small as possible. Since most preferably the openings in the axial direction of switch element 8*a* are of a substantially constant width, the particular surface area ratio of openings in alignment is also directly proportional to the length in alignment of the openings in the direction of rotation of the switch element 8*a*. When the rotation speed of the switch element 8*a* is increased, the adjustment element 14 rotates with respect to the body 2 such that the length in alignment of the openings, and thus the overall surface area as well, increases. If the position of the adjustment element 14 is connected to automatically follow the rotation speed of the switch element 8*a*, the position thereof is adjusted by a separate control unit 12. The influence of the rotation speed of the switch element 8*a* on the control element 12 and the influence of the control unit 12 on the adjustment element 14 are schematically shown in broken lines 13*a* and 13*b*, respectively.

The invention has been disclosed in the description and in the drawings only by way of example, and it is by no means restricted thereto. Different details of embodiments may be implemented in different ways and they may be combined with one another. The embodiments shown in FIGS. 2*a* to 2*b* and, similarly, in FIGS. 3*a* to 3*b* can be applied both to control valves equipped with reciprocally linearly or rotatably movable switch elements 8*a*, and to various control valves equipped with rotatable switch elements 8*a*. Various suitable sealing elements may be provided between the switch element 8*a* of the control valve 8 and the body 2 and, similarly, the adjustment element 14 for reducing or eliminating leaks between the switch element 8*a* of the control valve 8 and the body 2 and, similarly, the adjustment element 14. The adjustment element may be provided on either side of the control valve. The rotation or reciprocal movement of the switch element 8*a* of the control valve 8 may be implemented in any manner known per se, either mechanically, electrically, pneumatically or hydraulically. Similarly, the adjustment of the position of the adjustment element 14 may be implemented in any manner known per se, either mechanically, electrically, pneumatically or hydraulically. Although the control valve equipped with a rotatable switch element 8*a* is shown by way of example in a form wherein it is provided with a cylindrical valve part, it may also similarly be implemented in the form of a disc, cone or the like. Furthermore, instead of openings provided through the switch element 8*a* of the control valve, groove-like channels provided in the switch element 8*a* may also be used. The pressure fluid inlet and discharge channels do not necessarily have to be situated on opposite sides of the switch element, either, as long as they are located at different points. The influence of the pressure of the pressure fluid has to be adjusted only as far as the generation of a stress pulse is to be adjusted. Hence, in the case of FIG. 1*a*, it will suffice to adjust the time during which the inlet channels for pressure fluid are open, and in the case of FIG. 1*b* it will suffice to adjust the time during which the discharge channels for pressure fluid are open. As to the other channels, it will suffice that the times during which they are open are sufficiently long. In addition to the shown order, the switch element and the adjustment element may also reside with respect to one another such that the adjustment element is situated on a side of the pressure fluid inlet and discharge channels while the switch element is situated on a side of the working chamber. Further, the channels of the adjustment element and the switch element may be directly connected to the working chamber, or other inlet and discharge channels may be provided therebetween. These other inlet and discharge channels may also be the same ones, i.e. the same channels serve both as inlet and discharge channels with respect to the working chamber, as long as their openings in the control valve are arranged as required by the invention.

The invention claimed is:

1. A method for controlling a pressure fluid operated percussion device which allows a tool movable in a longitudinal direction of the tool with respect to a body of the percussion device to be installed therein, comprising:

providing a working chamber and therein a transmission piston installed movably in the axial direction of the tool;

suddenly compressing the tool in the longitudinal direction of the tool by a pressure of pressure fluid influencing the transmission piston such that a stress pulse is generated in the tool in the longitudinal direction of the tool and the stress pulse progresses through the tool into a material to be broken;

providing a control valve which includes inlet and discharge channels for conveying pressure fluid to and from the percussion device and which also includes a movably installed switch element provided with channels for switching, via the channels of the switch element, the inlet channels and, similarly, the discharge channels to alternately feed pressure fluid into the working chamber to influence the transmission piston and, similarly, to discharge pressure fluid that influenced the transmission piston from the working chamber; and adjusting the length of the stress pulse by adjusting the time during which the pressure of the pressure fluid influencing the transmission piston and, therethrough, pressing the tool, influences the tool while the speed of the switch element remains constant.

2. A method as claimed in claim 1, wherein in order to generate a stress pulse, the pressure of the pressure fluid is conveyed to influence the transmission piston on a side thereof opposite to the tool, and that the influence time of the pressure fluid is adjusted by adjusting, in the control valve, the time during which an opening of the pressure fluid inlet channel is open.

3. A method as claimed in claim 1, wherein the transmission piston, on the side thereof opposite to the tool, is arranged to be continuously influenced by the pressure of the pressure fluid, that the transmission piston, on a side facing the tool, is arranged to be alternately influenced by the pressure of the pressure fluid, and, similarly, in order to generate a stress pulse, pressure fluid that influenced the transmission piston is discharged, and that the influence time of the pressure fluid is adjusted by adjusting the time during which an opening of the pressure fluid discharge channel is open.

4. A method as claimed in claim 1, wherein the influence time of the pressure fluid is adjusted by adjusting an adjustment element by aligning or misaligning channels within the adjustment element with input and output channels and also by adjusting the speed of movement of the switch element of the control valve.

5. A method as claimed in claim 1, wherein the influence time of the pressure fluid is adjusted by adjusting, in the control valve, the length of an opening of a pressure fluid channel in the direction of movement of the switch element of the control valve.

6. A method as claimed in claim 5, wherein the length of the opening of the pressure fluid channel is adjusted in proportion to the speed of movement of the switch element of the control valve.

7. A method as claimed in claim 6, wherein the length of the opening of the pressure fluid channel is adjusted such that the influence time is substantially constant, irrespective of the speed of movement of the switch element.

8. A method as claimed in claim 1, wherein the length of the opening of the pressure fluid channel in the control valve is adjusted on the basis of drilling conditions, such as type of rock.

9. A percussion device which allows a tool to be installed therein movably in a longitudinal direction of the tool with respect to a body of the percussion device, comprising a working chamber and therein a transmission piston installed movably in the axial direction of the tool in order to suddenly compress the tool in the longitudinal direction of the tool by a pressure of pressure fluid influencing the transmission piston such that a stress pulse is generated in the tool in the longitudinal direction of the tool and the stress pulse progresses through the tool into a material to be broken;

a control valve which includes inlet and discharge channels for conveying pressure fluid to and from the percussion device and which also includes a movably installed switch element provided with channels for switching, by means of the switch element and via the channels thereof, the channels to alternately convey pressure fluid into the working chamber to influence the transmission piston and, similarly, to discharge pressure fluid that influenced the transmission piston from the working chamber;

an adjustment element provided with channels for pressure fluid, wherein the switch element is arranged to convey pressure fluid to and from the working channel via the channels of the adjustment element; and a control unit that controls the speed of the switch element and comprises adjustment means for adjusting the adjustment element to influence time of the pressure of the pressure fluid being fed to the percussion device via the control valve and influencing the transmission piston and, therethrough, compressing the tool.

10. A percussion device as claimed in claim 9, wherein with respect to the tool, the working chamber is located on a side opposite to the transmission piston, and that the adjustment means for adjusting the influence time of the pressure of the pressure fluid being fed to the percussion device via the control valve and compressing the tool comprise means for adjusting the time during which an opening of at least one inlet channel controlling the feed of pressure fluid into the percussion device in the control valve is open.

11. A percussion device as claimed in claim 9, wherein with respect to the tool, the working chamber is located on the same side of the transmission piston, that on a side of the transmission piston opposite to the tool an auxiliary chamber is located wherein a continuous pressure of the pressure fluid is arranged to influence the transmission piston, that the control valve is arranged to alternately allow pressure fluid into the working chamber to influence the transmission piston and, similarly, in order to generate a stress pulse, to discharge pressure fluid that influenced the transmission piston, and that the adjustment means for adjusting the influence time of the pressure of the pressure fluid being fed to the percussion device via the control valve and compressing the tool comprise means for adjusting the time during which an opening of at least one discharge channel controlling the discharge of pressure fluid from the percussion device in the control valve is open.

12. A percussion device as claimed in claim 9, wherein in order to adjust the influence time of the pressure of the pressure fluid, the length of the inlet or the discharge channel and/or the channel of the switch element of the control valve is adjusted in the direction of movement of the switch element of the control valve by means of the adjustment element.

13. A percussion device as claimed in claim 9, wherein in order to adjust the influence time of the pressure of the pressure fluid, the position of the inlet or the discharge channel leading to/from the control valve and, similarly, the position of the channel leading to the working channel are moved with respect to one another in the direction of movement of the switch element of the control valve by moving the adjustment element.

14. A percussion device as claimed in claim 9, wherein a plurality of parallel openings is provided from the inlet channel and, similarly, from the discharge channel to the control valve and, similarly, to the working chamber, that the switch element and the adjustment element are provided with a corresponding number of channels for alternately connecting the openings of the inlet channels and, similarly, the discharge channels with the working chamber, and that the adjustment means are arranged to adjust the time during which all the openings of the inlet channels and/or the discharge channels are open.

15. A percussion device as claimed in claim 9, wherein the switch element of the control valve is installed rotatably with respect to the body of the percussion device.

16. A percussion device as claimed in claim 9, wherein the switch element of the control valve is installed reciprocally movably with respect to the body of the percussion device.

17. A percussion device as claimed in claim 9, wherein at least some of the channels provided in the switch element of the control valve are grooves provided in a surface of the switch element.

18. A percussion device as claimed in claim 9, wherein at least some of the channels provided in the switch element of the control valve are openings through the switch element.

19. A percussion device as claimed in claim 9, wherein it comprises control means for controlling the adjustment element, and that the control means are connected to control the adjustment element in accordance with the speed of movement of the switch element of the control valve such that at least within a predetermined range of speed of movement of the switch element, the time during which the pressure fluid channels are open remains substantially constant.

20. A percussion device which allows a tool to be installed therein movably in a longitudinal direction of the tool with respect to a body of the percussion device, comprising:

a working chamber and therein a transmission piston installed movably in the axial direction of the tool in order to suddenly compress the tool in the longitudinal direction of the tool by a pressure of pressure fluid influencing the transmission piston such that a stress pulse is generated in the tool in the longitudinal direction of the tool and the stress pulse progresses through the tool into a material to be broken;

a control valve which includes inlet and discharge channels for conveying pressure fluid to and from the percussion device and which also includes a movably installed switch element provided with channels for switching, by means of the switch element and via the channels thereof, the inlet and discharge channels to alternately feed pressure fluid into the working chamber to influence the transmission piston and, similarly, to discharge pressure fluid that influenced the transmission piston from the working chamber; and an adjustment element provided with channels for pressure fluid, wherein the switch element is arranged to feed pressure fluid to and from the working channel via the channels of the adjustment element, and that the influence time of the pressure of the pressure fluid being fed to the percussion device via the control valve and influencing the transmission piston and, therethrough, compressing the tool is adjusted by means of the adjustment element irrespective of a change in speed of the switch element.

21. A percussion device which allows a tool to be installed therein movably in a longitudinal direction of the tool with respect to a body of the percussion device, comprising:

a working chamber and therein a transmission piston installed movably in the axial direction of the tool in order to suddenly compress the tool in the longitudinal direction of the tool by a pressure of pressure fluid influencing the transmission piston such that a stress pulse is generated in the tool in the longitudinal direction of the tool and the stress pulse progresses through the tool into a material to be broken;

a control valve which includes inlet and discharge channels for conveying pressure fluid to and from the percussion device and which also includes a movably installed switch element provided with channels for switching, by means of the switch element and via the channels thereof, the inlet and discharge channels to alternately feed pressure fluid into the working chamber to influence the transmission piston and, similarly, to discharge pressure fluid that influenced the transmission piston from the working chamber; and an adjustment element provided with channels for pressure fluid, wherein the switch element is arranged to feed pressure fluid to and from the working channel via the channels of the adjustment element, and wherein the switch element is arranged to adjust the length of stress pulses irrespective of a change in frequency of the stress pulses.

* * * * *